US005221396A

United States Patent [19]

Kane

[11] Patent Number: 5,221,396

[45] Date of Patent: Jun. 22, 1993

[54] METHOD OF MASS MANUFACTURE OF RIGID DISPLAY SIGN

[75] Inventor: Michael Kane, Chicago, Ill.

[73] Assignee: Kane Graphical Corporation, Chicago, Ill.

[21] Appl. No.: 849,943

[22] Filed: Mar. 12, 1992

Related U.S. Application Data

[62] Division of Ser. No. 393,600, Aug. 14, 1989, Pat. No. 5,096,758.

[51] Int. Cl.[5] ..... B44C 5/04

[52] U.S. Cl. ..... 156/250; 428/187; 428/913.3

[58] Field of Search ..... 428/40, 187, 913.3; 156/250; 40/124.5

[56] References Cited

U.S. PATENT DOCUMENTS

| | | | |
|---|---|---|---|
| 3,940,864 | 3/1976 | Kanzelberger | 428/40 X |
| 4,125,655 | 11/1978 | Kanzelberger | 428/67 |
| 4,132,018 | 1/1979 | Hughes | 428/913.3 X |
| 4,190,691 | 2/1980 | Kramer | 428/187 X |
| 5,096,758 | 3/1992 | Kane | 428/40 |

*Primary Examiner*—Henry F. Epstein

*Attorney, Agent, or Firm*—Wallenstein, Wagner & Hattis, Ltd.

[57] ABSTRACT

A mass-production technique for fabricating individual indicia-bearing display sign plaques (10) employs fabricating sheets of large plaque stock (36) as a laminate of a stiffening substrate (12) and an indicia-bearing front sheet (22) adheringly affixed thereto, the indicia (24) on the front sheet bearing the indicia of the desired plaque replicated thereon preferably as a large rectangular array of elements having common boundaries subsequently to be severed along severance lines (38). For wall-mounting of finished plaques adhesive tape strip stock (40) is affixed to lie generally centered on the common boundaries of the array elements, as well as around the periphery of the laminate stock. An edge-registered stack (41) of laminates 41 is then cut along the severing lines by repeated passes of a guillotine-type blade 42. The material forming the substrate and all layers emplaced thereon is chosen to yield clean shearing under such a blade, with the result that the individual plaques 10 when separated have clean sharp edge faces with the peripheral adhesive tape precisely edge-registered thereto. Hot-forming of finished plaques allows them to be configured into self-supporting structures

11 Claims, 5 Drawing Sheets

Fig. 1
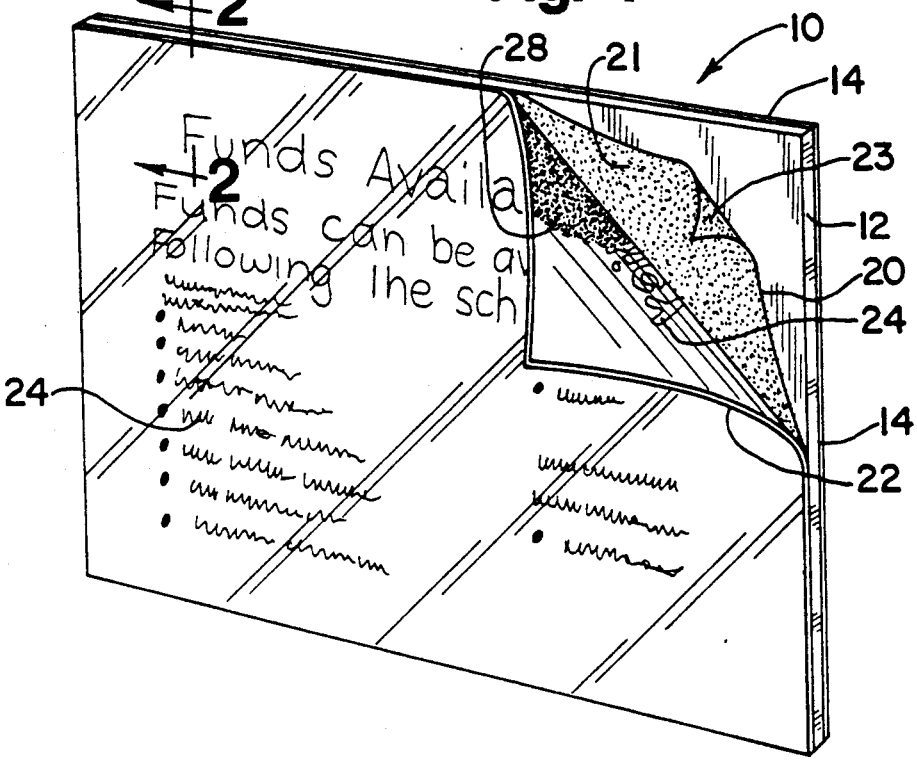
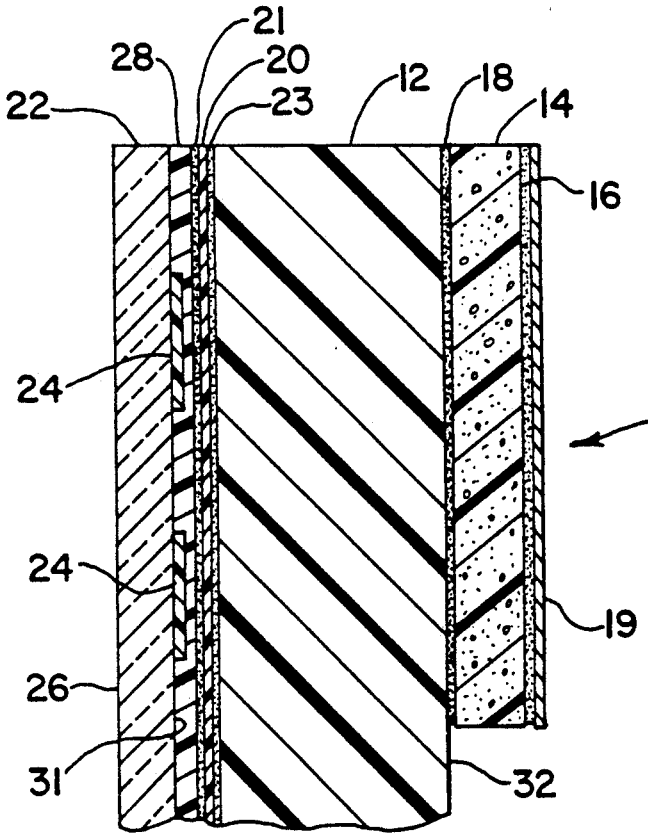
Fig. 2

Fig. 8
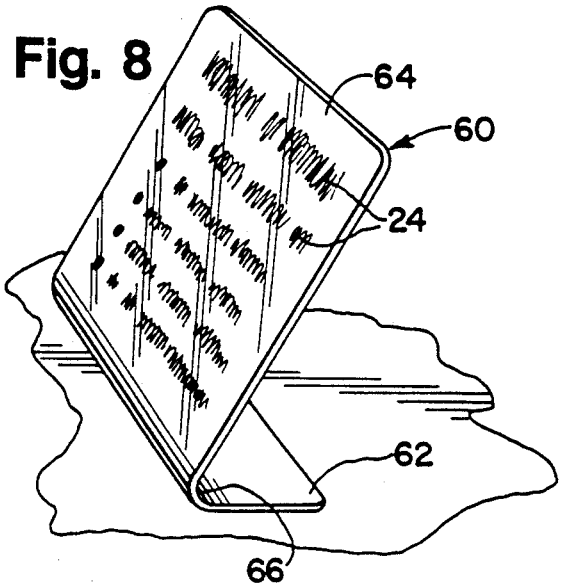
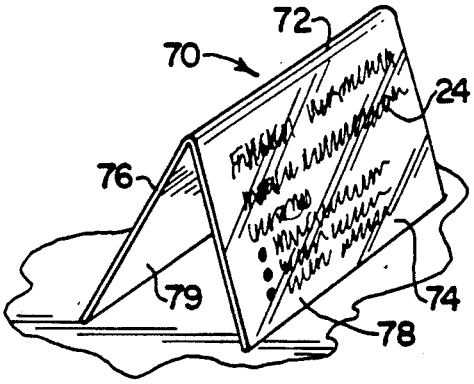
Fig. 9
Fig. 10
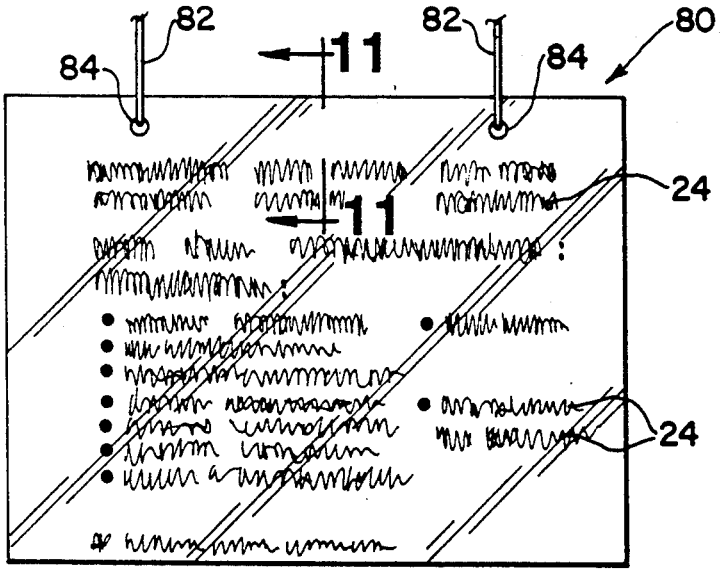
Fig. 11
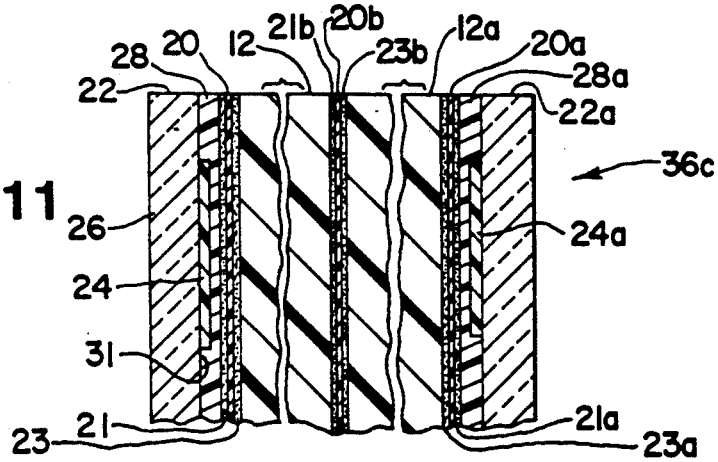

METHOD OF MASS MANUFACTURE OF RIGID DISPLAY SIGN

This is a divisional of copending application Ser. No. 07/393,600, filed on Aug. 14, 1989, now U.S. Pat. No. 5,096,758.

DESCRIPTION

1. Technical Field

The technical field of the invention is the display sign art.

2. Background of the Invention

One common form of sign-forming plaque heretofore manufactured comprises a relatively thin, indicia-bearing front layer of material which is laminated to a rigid, generally brittle self-supporting sign body which cannot be cut by use of a shearing device. Sometimes adhesive strips are adhered to the rear of the sign body to secure the same to a smooth vertical wall surface. Since it is extremely difficult to precisely align these adhesive strips to the edges of the sign body in mass-production manufacture, they are generally positioned on the sign body slightly inwardly offset from the margins thereof. This leaves an unsightly gap when the plaque is secured to a vertical wall surface. There is also a problem in precisely aligning the thin indicia-bearing front layer with the margins of the rigid sign body. Typically this relatively thin indicia-containing layer is initially made of a larger size than the sign body, so that after the indicia-carrying layer is applied to the sign body it is trimmed as evenly as possible to coincide with the margins of the sign body.

The individual effort needed to assemble such a plaque is quite substantial, and mass production thereof was considered impractical. Because of the unique construction of the plaque of the present invention and the method of making the same, sign-forming plaques of types that mount on a vertical support wall, or types which can be stably supported on a horizontal support surface or hung from the ceiling, can be mass produced in a very expeditious inexpensive way.

SUMMARY OF THE INVENTION

According to a feature of the invention, individual preferably rectangular sign-forming plaques are formed by severing them from large preferably rectangular laminated sheets of synthetic plastic material. All of the sheets forming the laminate stock are made of a material which can be sheared in one cut by a guillotine-type blade or similar shearing tool to produce a smooth even edge which does not require any framing to cover them. The sign-forming indicia to be presented on individual plaques is replicated as an array or pattern of sign-forming indicia visible from the outer surface of a preferably thin, indicia-bearing sheet of the laminate stock. The laminate stock has a stiffener sheet generally thicker than the front sign indicia-bearing sheet, and is adheringly interfacially secured thereto. In the preferred form of the invention the indicia are coated as by silk-screening on the interior surface of the indicia sheet, which is transparent. There is also preferably provided an opaque layer behind the coated indicia to provide a contrasting background to the sign-forming indicia. The opaque layer can be paint coated over the entire indicia-covered surface of the thin indicia-bearing sheet.

In the preferred form of the invention the indicia-bearing sheet and the stiffener sheet are secured together by means of an intermediate thin adhesive-coated sheet interposed between the indicia-bearing and stiffener sheets. Compression of the assembly together then produces one integrated laminate stock body.

To provide wall-mountable plaques, adhesive tape is applied in strips to the outer surface of the stiffener sheet centered on and overlapping the common aligned linear boundaries of the various sign elements to be cut from the laminate stock, as well as peripherally on the laminate stock along the edges thereof. A number of sheets of laminate stock so prepared are then assembled as an edge-registered stack, and a guillotine shearing blade is passed through the stack along various common margins of the sign elements and along the margins of the stock. These cut lines also pass through the midlines of the adhesive tapes. Such a cutting operation produces a clean separation of the individual sign elements from each other and produces perfectly aligned, smooth sign elements and adhesive tape edges requiring no finishing operations.

According to another aspect of the invention, self-supporting sign plaques may be produced by the above-mentioned method, but omitting the application of the adhesive tape strips. In this case the severing is again done along the common indicia boundaries cf the various sign elements, each of which has at least one sign indicia-containing section and a sign element support section which can also be an indicia-containing section. In this form of the invention, at least the stiffener layer is made of a thermo-plastic material so that after separation of the individual sign elements from the laminate stock, each sign element is bent under local application of heat at the intersection of the sign indicia-containing section of the support section so that the latter forms a base support portion supporting the plaque upright on a horizontal support surface where the other section is generally vertically disposed.

Another form of the invention is a plaque having sign indicia on both faces thereof to be hung from cords. Here the final laminate stock comprises a body having indicia-bearing sheets on both faces. This is preferably accomplished by preparing laminate stock as described above for the wall mounted version of the invention, less the adhesive tape strips. The final laminate stock is formed from a pair of such laminate stock sheets secured together at their respective stiffener layer outer surfaces by an adhesive sheet coated with adhesive on both sides as was the adhesive sheet securing the thin indicia-containing sheet to the stiffener sheet.

Other features and advantages of the invention will be apparent from the drawings, description, and claims to follow.

BRIEF DESCRIPTION OF DRAWINGS

FIG. 1 is a perspective view of one form of a display sign plaque of the present invention showing the various layers of the laminated structure forming the plaque peeled back to show details thereof.

FIG. 2 is a fragmentary, greatly magnified cross-section view showing the layers of the plaque shown in FIG. 1, and taken along section line 2—2 therein.

FIG. 8 shows another embodiment of a plaque of the invention which has been heat-formed from an initially coplanar or flat form cut from a laminate body similar to that shown in FIG. 4 but without the adhesive tape strips to provide a horizontal base supporting portion for mounting on a horizontal surface.

FIG. 9 shows another version of plaque made in a similar way as the plaque of FIG. 8 to form a triangular stand-up configuration presenting sign indicia on both sides thereof.

FIG. 10 shows another embodiment of plaque configured to be hung from a pair of downwardly depending support cords.

FIG. 11 is a cross-section view of the plaque shown in 10 taken along cut lines 11—11 therein.

DESCRIPTION OF EXEMPLARY FORM OF INVENTION

Figure 3:
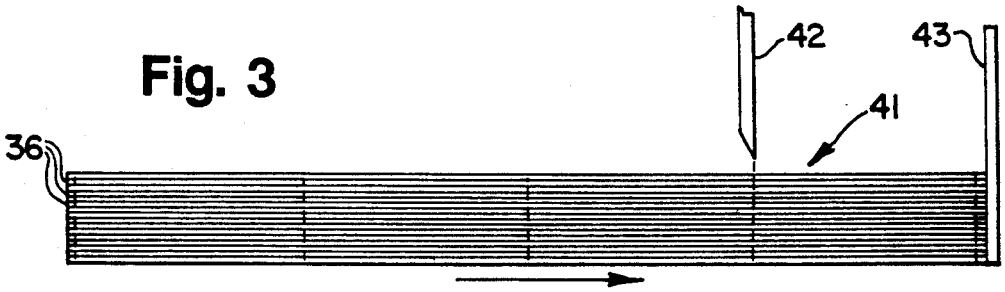
FIG. 3 is a side view of a stack of laminate bodies from which the plaque of FIGS. 1 and 2 can be mass produced, and positioned for shearing by a guillotine-type shearing blade to form individual plaques.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Referring now to the Figures, FIG. 1 shows a display sign configured as a plaque 10 to be mounted on a smooth upright surface, such as a wall. FIG. 2 is a cross-section thereof.

The plaque 10 has a relatively thick rear stiffened layer 12 to impart the necessary rigidity to the structure, and having peripherally disposed around all the margins of the rear surface thereof strips of double sided polyurethane foam adhesive tape 14 having adhesive layers 16, 18 and having a peelable cover layer 19. The adhesive tape 14 is in turn secured to the rearwardly facing major surface of the stiffener layer 12. The substrate 12 is to be made from a non-brittle material which can be cleanly cut by a shearing blade (guillotine knife blade) without cracking or spalling, so as to produce clean edges. In the preferred form of the embodiment the stiffener layer 12 is made of styrene plastic of the order of 0.080 inches thickness.

An adhesive layer 20 made of a similarly shearable material preferably 0.0005 inches thickness and made preferably of a terephthalate plastic, such as that known under the trade name Mylar, is provided with adhesive coatings 21, 23 on either side thereof. The adhesive sheet 20 is pressed into contact against the forward face of the substrate 12.

A relatively thin transparent front indicia-container layer 22 is provided having the desired indicia 24 silk-screened thereon and visible from a front surface 26 of the layer 22, the front layer 22 being emplaced on top of the adhesive layer 20 and pressed adheringly into contact therewith.

The front layer 22 is similarly made of a cleanly-shearable synthetic plastic material, preferably of the type manufactured under the trademark Lexan, and having a thickness of the order of 0.010 inches. This material in the thicknesses indicated is similarly cleanly shearable by a guillotine knife blade. The adhesives employed to bond the structure together are preferably of the self-setting type; however, thermal setting adhesives may be employed if desired.

The indicia 24 are visible from the transparent front of the plaque 10. To provide the necessary contrast, an opaque layer 28 may be applied to the rear surface 31 of the front layer. A less desirable form of the invention envisions the use of an opaque front layer printed with indicia on the front face but the form illustrated protects the indicia from the external elements as well as against abrasion.

The cleanly shearing property of the laminate forming the plaque 10 lends itself to a simplified mass-production method of manufacture of such plaques which will be described next with particular reference to FIGS. 3 and 4. Rather than fabricate the plaques individually, the stiffener layer is initially fabricated from large sheets of substrate stock. Adhesive sheets to form the adhesive layer 20 are similarly provided of identical dimension and are adheringly secured to the stiffener layer sheet. An indicia-bearing front sheet from which front layer 22 is formed is prepared, with the indicia repeated in aligned rows and columns to form the front layer sheet stock of similar dimension to the stiffener layer sheet. It is pressed upon the adhesive layer sheet to form a single laminate body (laminate stock) 36 shown in FIG. 4 from which the individual plaques can be cut along severance lines along common aligned margins of the plaques. FIG. 4 shows the laminated body 36 viewed from the side which will form the rear surface 32 of the stiffener layers 12 of the plaques.

The laminated body 36 and indicia thereon are configured to provide a 4×4 array of plaques 10. Strips of adhesive tape 40 which will ultimately form the marginally disposed adhesive tapes 14 for the individual plaques are laid and centered over the severance lines 38 as indicated in FIG. 4, to complete the laminate body 36 from which the plaques are mass produced.

Figure 4:
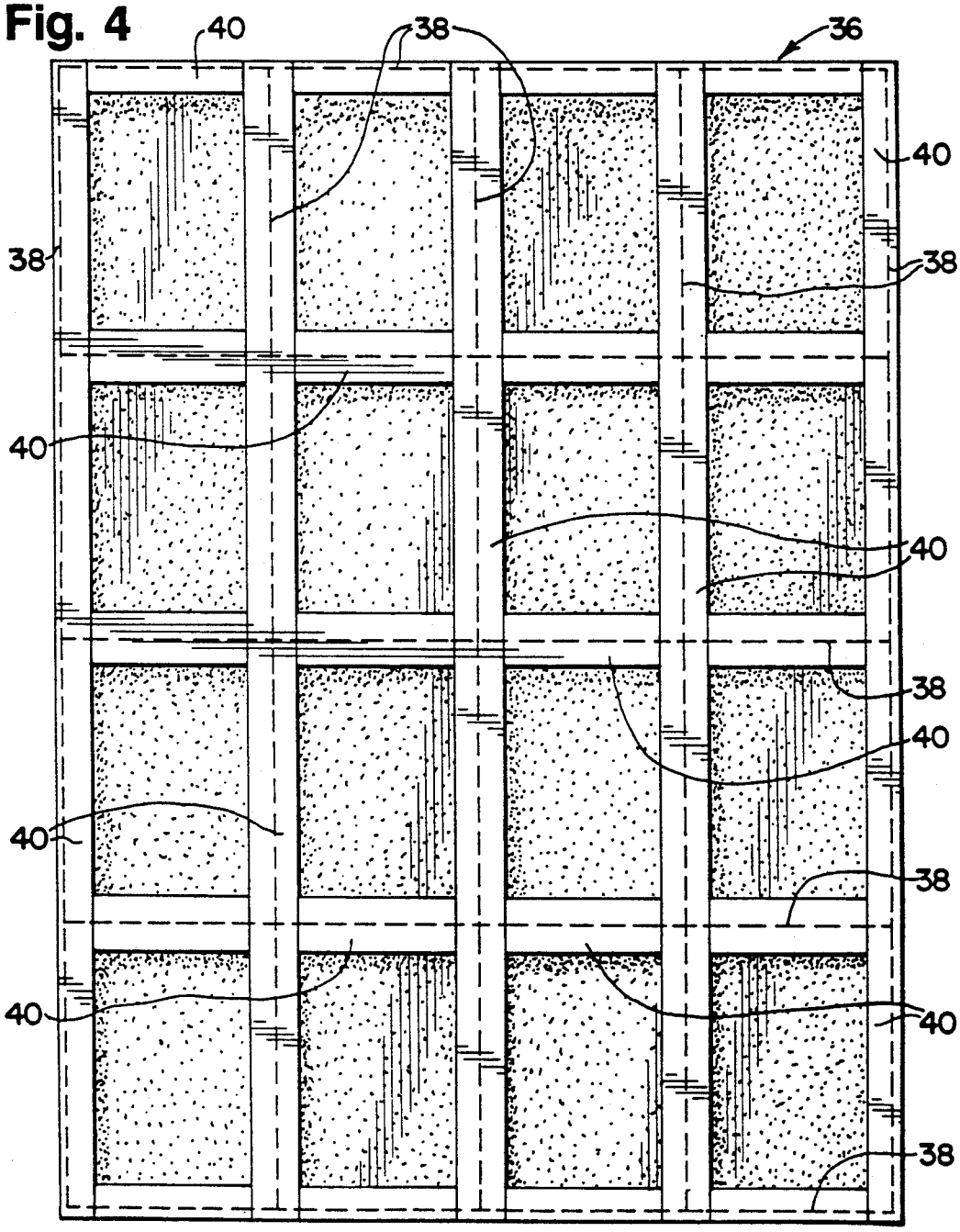
FIG. 4 is a top view of one of the laminates shown in FIG. 3, showing adhesive strips positioned thereon.
Figure 5:
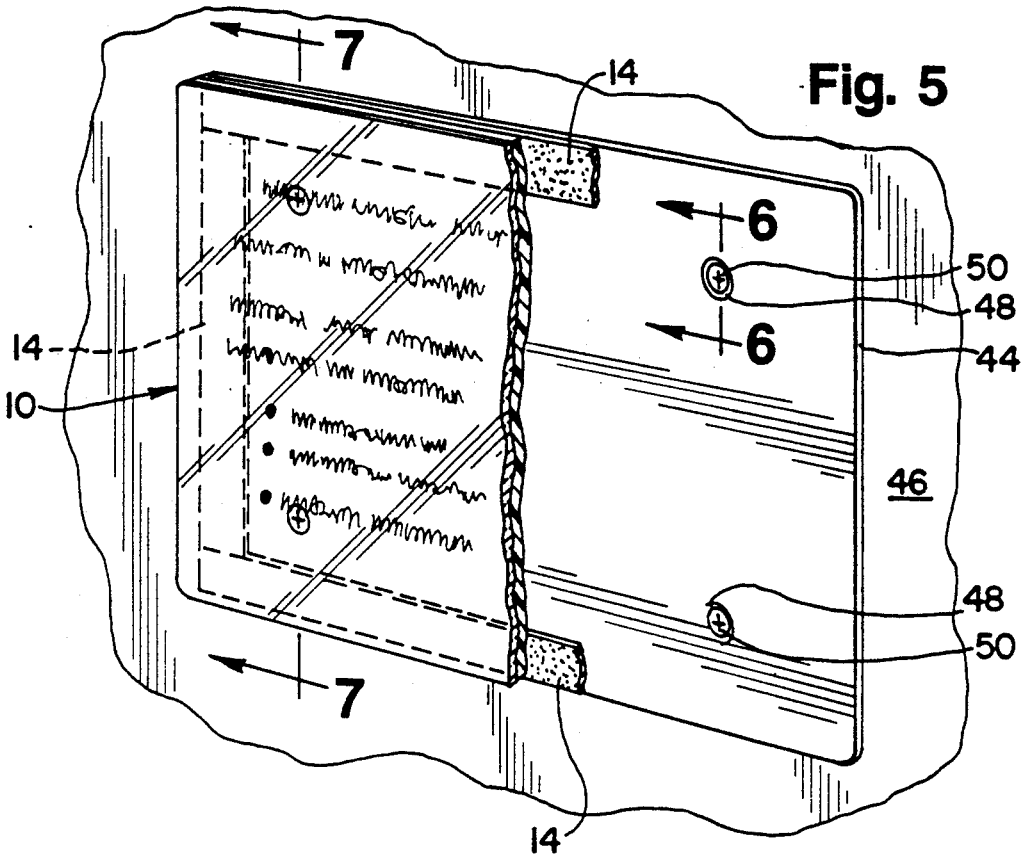
FIG. 5 is a partially cut-away view of a plaque of the type shown in FIG. 1 adhesively mounted to a smooth accessory plate mounted in turn to a wall surface.
Figure 6:
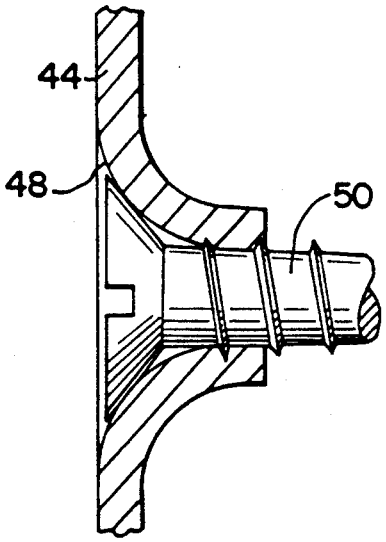
FIG. 6 is a cross-section view of the accessory plate shown in FIG. 5 and taken along section line 6—6 therein.

To facilitate mass production, a number of laminated stock bodies 36–36 are overlaid in edge-registered form as shown in FIG. 3 against an aligning and positioning wall 43. A guillotine severing blade 42 is then sequentially located by moving the wall 43 on the blade 42 to align sequentially to blade with each of the various severance lines when the blade is forced down through the stack of laminate bodies 36–36. Guillotine severing blade machines, frequently operating under program control are routinely used in the printing industry. When the laminate bodies 36 have been severed along all the severance lines 38, individual plaques 10 as shown in FIGS. 1 and 2 are thus produced with the mounting adhesive tape 14 peripherally disposed around them, and extending exactly to the edges of each plaque. Because of the nature and thicknesses of the materials used, all plaques have smooth even edges requiring no further finishing operations or framing.

Figure 7:
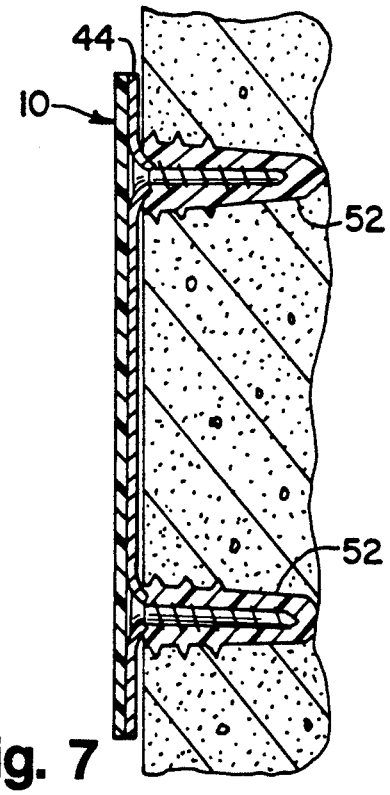
FIG. 7 is a cross-section view of the wall-mounted plaque of FIG. 5 taken along section line 7—7 therein.

FIG. 7 shows a smooth accessory mounting plate 44 used to mount plaques 10 to a rough upstanding wall surface upon which the adhesive tape would not effectively adhere. The plate 44 is preferably configured to exactly match the outlines of the plaque 10 to be mounted thereon by means of the strips of adhesive tape 14. It is provided with a plurality of dimple-formed stamped recesses 48 designed to accommodate flat-head screws 50 therein. These screws in turn are affixed to the wall 46, using expansion anchors 52 in the case of masonry walls. With the plate 44 so affixed to the wall 46, the plaque 10 may be adhesively secured thereto.

Figure 12:
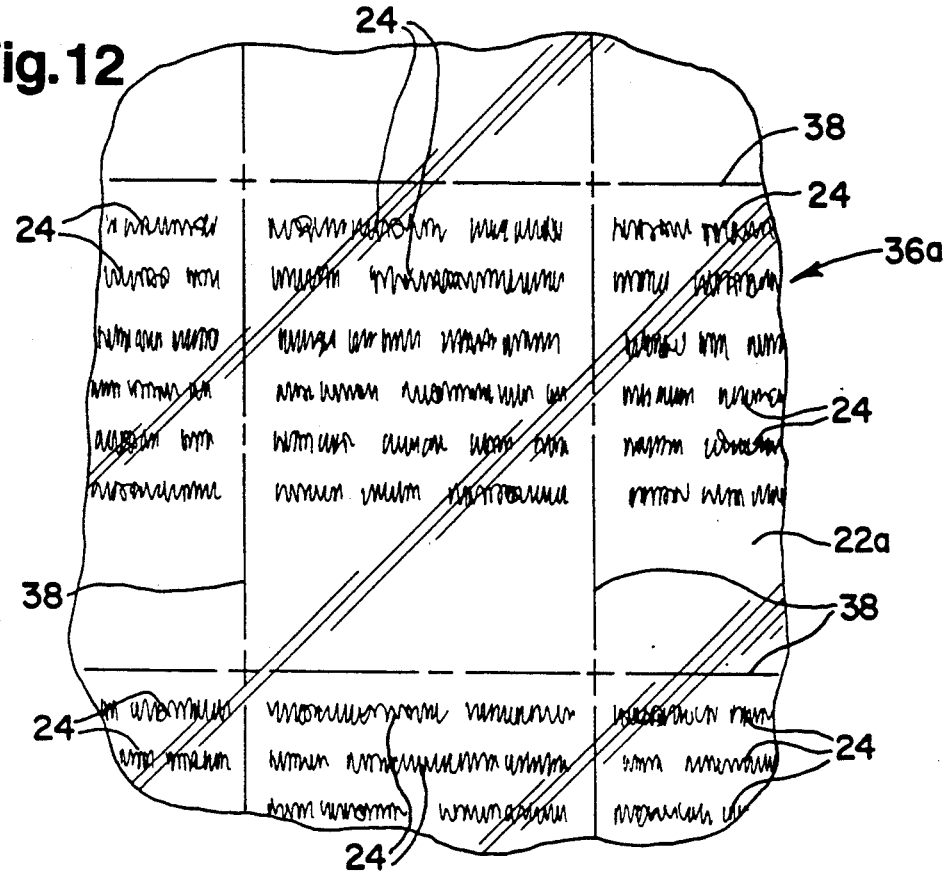
FIG. 12 shows a fragmentary view of the laminate body from which the plaque of FIG. 8 was made.

FIG. 8 shows an alternative form of plaque 60 configured to be self-supporting on a horizontal surface. It will be recalled that the stiffener layer 12 of the plaque shown in FIG. 1 imparts the principal stiffness to the structure. Not only does the preferred styrene substrate plastic possess the necessary anti-spalling shearing properties, but it is also a thermo-plastic material, as a result of which a suitably configured plaque 60 of the type shown in FIG. 8 may be hot-formed to provide a folded-back base support portion 62 joining an indicia-bearing upper portion 64 by an arcuate bend 66. FIG. 12 shows a portion of laminate stock 36*a* having the layout of its indicia modified so that the indicia reside only within the upper portion 64 of the completed plaque 60.

Figure 13:
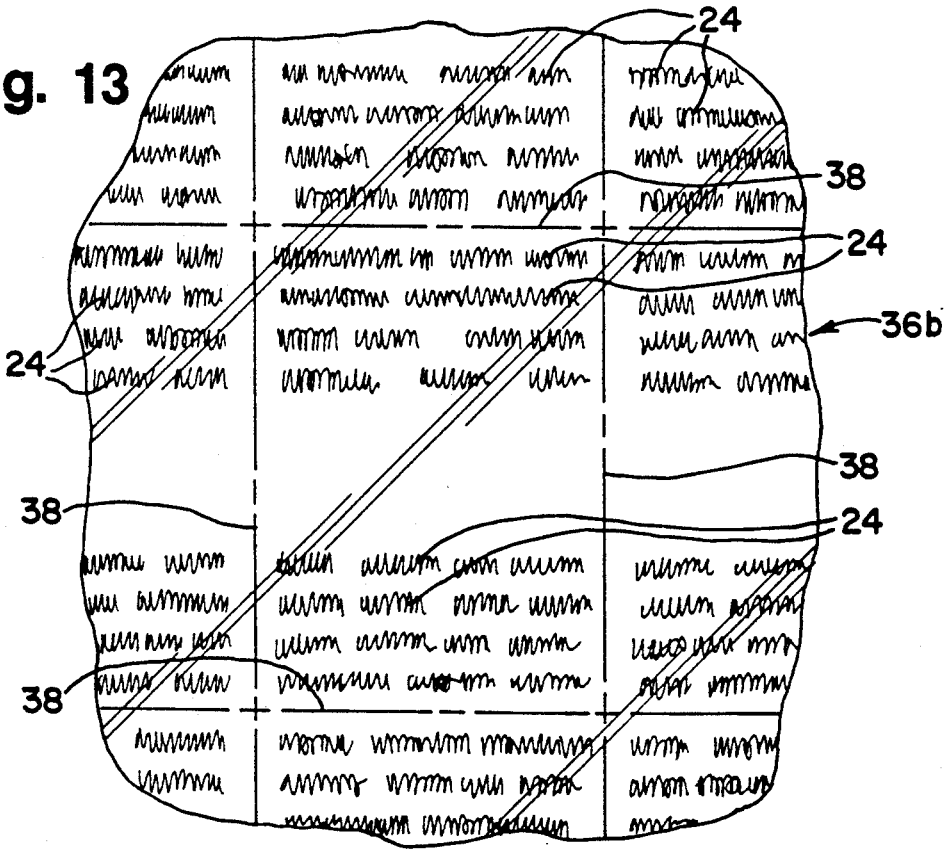
FIG. 13 shows a fragmentary view of the laminate body from which the plaque of FIG. 9 was made.

FIG. 9 shows a similarly self-supporting structure 70 wherein the plaque 70 has been hot-formed and bent about a joining axis 72 to provide a front portion 74 bearing the sign-forming indicia 24 thereon, joined to a rear portion 76 of similar dimension having identical indicia, the two portions extending away from each other at the bottom so that their lower edges 78, 79 form supporting surfaces for support on a horizontal surface there below. FIG. 13 shows the layout of the indicia on a modified laminate stock 36*b*, with the indicia 24 laid out to leave a clear central region about which the individual plaques are folded along the joining line 72 of FIG. 8.

FIG. 10 shows another form of plaque 80 configured to be hung by means of supporting cords 82 passing through holes 84 disposed near the upper edge of the plaque 80. Here rear-mounted adhesive tapes 14 as shown in FIGS. 1 and 2 are not needed, and since the plaque 80 is visible from both sides, in the preferred form these plaques are fabricated with indicia on both sides as shown in the cross section of FIG. 11. This is preferably accomplished by preparing laminar stock of the type shown in FIG. 2, but omitting the adhesive tape 14, and mounting it to a second sheet of laminar stock similarly having a stiffener layer 12*a*, a Mylar sheet 20*a* with adhesive coatings 23*a*, 21*a* on opposite faces thereof laminating the stiffener layer against the opaque layer 28*a* of an outer layer 22*a* having indicia 24*a* on the interior surface thereof. The final sheet of laminate stock 36*c* is formed by placing the respective stiffener layers 12, 12*a* in a confronting relationship, and sealing them together by means of a similar adhesion sheet 20*b* having adhesive layers 21*b*, 23*b* on opposite faces thereof.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A method of mass-producing indicia-bearing sign plaques comprising the steps of:

A. forming a laminate body : providing at lest a first sheet of synthetic plastic material many times larger than a single plaque; providing on said first sheet multiple patterns of sign-forming indicia forming sign elements sharing common straight margins along straight severance lines so that many identically sized sign elements can be produced from said laminated body by severing along said severance lines, each of said elements having thereon and having visible from the outer surface of said first sheet said indicia; providing at least a second sheet of rigid self-supporting synthetic plastic material of approximately the same overall size as said first sheet; laminating said second sheet to the inner surface of said first sheet, all sheets of said laminated body being made of a material which can be severed cleanly by a guillotine shearing blade so as to present immediately after cutting smooth, even edges; and B. shearing the laminated body so formed along said common margins by said shearing blade to separate adjacent sign-forming elements from each other, so as to produce individual plaques with smooth, even edges which do not require framing to cover same.

2. The method of claim 1 wherein said first sheet is relatively thin and flexible.

3. The method of claim 1 wherein the margins of the sign elements to be formed from said laminate body form a rectangular array aligned in rows and columns and having said common straight margins, and further including the steps of:

applying strips of adhesive tape to the outer surface of said second sheet and generally centered on and overlapping said sign element margins; and applying a straight shearing blade to said laminate body along said common margins to separate said sign elements from each other to provide a plurality of plaques having the outer margins of said strips of tape in precise alignment with the other layers of each plaque.

4. The method of claim 1, wherein each of said sign elements includes a generally upstanding sign-forming section and an attached integral sign support section for supporting said sign-forming section upon a horizontal support surface, said two sections being initially in a common plane and formed by contiguous sections of said laminate body within the confines of each sign-forming element thereof, the laminate body being made of a bendable material so that when individual sign elements are severed from the laminate body the two sections of each sign element can be moved out of coplanar relationship thereof to form sign-forming and support-forming sections of the plaque and said method further including the steps of moving said two sections of each sign element out of coplanar relationship after each sign element has been sheared from said laminate body.

5. The method according to claim 4 wherein at least said second sheet is made of thermoplastic material, and further including after separation of said individual sign elements the step of:

bending by hot-forming each sign element so separated so that each has at least one up-standing sign-forming section bearing sign-forming indicia and a support-forming section configured to give stability to the overall sign so as to be self-supporting on a horizontal support surface.

6. The method of claim 5 wherein said support-forming section is generally planar forming a support base for said sign forming section and said sign-forming section joins said support base at an acute angle thereto.

7. The method of claim 5 wherein said support-forming section of each sign element is also a sign-forming section bearing sign-forming indicia, and said sign element being hot-formed and bent along a line between said sections through a given angle about said line so that said sections diverge away from each other and so that the ends of said sections remote from said axis form support edges for said plaque when placed on a horizontal surface.

8. The method according to claim 1, 3, or 4 wherein said front layer of said laminate body is made of transparent sheet material having said sign-forming indicia on the inner face thereof.

9. The method of claim 8 wherein the formation of said laminate body further includes the step of providing and affixing an opaque layer between said front sheet and said rear layer.

10. The method of claim 9 wherein said opaque layer is formed as a layer painted on said inner face of said front layer.

11. The method of claim 10 further including the steps of:

providing a relatively thin adhesion layer made of a plastic material which can be severed cleanly by said guillotine shearing blade so as to present a smooth edge and having adhesive coatings on both faces thereof; and interposing said adhesion layer between said opaque layer and said inner surface of said rear layer of said laminate body; and securing said front layer, adhesion layer, and rear layer of said laminate body together by means of said adhesive coatings.

* * * * *